United States Patent [19]

Holtz

[11] Patent Number: 4,702,059

[45] Date of Patent: Oct. 27, 1987

[54] JOIST SYSTEM FOR FORMING CONCRETE SLABS

[76] Inventor: Neal Holtz, 1739 Church St., NW., Washington, D.C. 20036

[21] Appl. No.: 886,856

[22] Filed: Jul. 18, 1986

[51] Int. Cl.[4] ..... E04H 12/00

[52] U.S. Cl. ..... 52/651; 249/23; 249/33

[58] Field of Search ..... 52/319, 326, 331, 333, 52/335, 337, 338, 339; 249/28, 29, 13, 18, 23, 24

[56] References Cited

U.S. PATENT DOCUMENTS

| | | | |
|---|---|---|---|
| 3,584,825 | 6/1971 | Williams | 249/23 |
| 3,861,634 | 1/1975 | Hood et al. | 249/23 X |
| 3,945,168 | 3/1976 | Butts et al. | 52/319 X |
| 3,954,248 | 5/1976 | Barber | 249/33 X |
| 4,223,866 | 9/1980 | Black | 249/24 X |

*Primary Examiner*—William F. Pate, III
*Assistant Examiner*—Creighton Smith
*Attorney, Agent, or Firm*—Pollock, Vande Sande & Priddy

[57] ABSTRACT

A support for a spanner bar in an open web bar joist system which is supported by a lower chord of the bar joist. The support includes a base member for securing the support to the lower chord, a first elongated vertical member which is affixed to the base member, and a second elongated member which is axially aligned with respect to the first member. Structure is provided for moving the second member axially with respect to the first member.

9 Claims, 7 Drawing Figures

JOIST SYSTEM FOR FORMING CONCRETE SLABS

BACKGROUND OF THE INVENTION

This invention relates to floor and roof constructions, and more particularly, to steel joists having supports for spanner bars which are used to support form work for pouring concrete slabs in place on steel joists.

In some methods of constructing floors and roofs, steels joists which are positioned to span structural supports hold forms, such as plywood sheets, and concrete is poured on the panels to form a slab. It is desirable to be able to reuse the panels and the supporting structure for the panels after the concrete has hardened and the forms are removed. In order to reuse the panels, the forms must be supported in such a way that they can be removed with little or no damage to them, and the prior art teaches a variety of techniques and apparatus for supporting forms in such a way that they can be removed and reused. However, some of the methods and apparatus are not applicable to open web joist systems; some of which may be used with open web joist systems are difficult to use in practice; and some of the methods and apparatus may raise safety questions.

The elements which support the panels must be kept from being encased in the concrete which is poured in order to be able to reuse them. In one type of system, metal bars, referred to herein as spanner bars, extend between adjacent joists and provide support for the concrete forms. The prior art methods of supporting spanner bars at the joists, especially at open web joists, can present problems in assembly, disassembly, adjustability, adaptability to a variation of joist structures, and safety.

The spanner bars typically are supported at or near the upper chord and have support means which are adapted to cooperate with or are an integral part of the upper chord. Some of these support means require special configurations for the top chord and the support means are typically encased in concrete and hence not reusable.

It is desirable that the support for the spanner bars can be assembled and disassembled by relatively unskilled labor using only simple tools. In handling heavy members of structural steel, workers usually wear gloves, and it is desirable that a minimum of care and little manual dexterity be needed to assemble and disassemble the elements of the support apparatus.

SUMMARY OF THE INVENTION

It is accordingly one object of this invention to provide apparatus for supporting a spanner bar at a joist which permits easy assembly and disassembly of the apparatus and the joist.

It is another object to provide apparatus for supporting a spanner bar at a joist which is readily adjustable in a longitudinal direction along the joist.

It is another object of this invention to provide apparatus for supporting a spanner bar at a joist which can accommodate a wide variation of joist sizes.

It is still another object of this invention to provide apparatus for supporting a spanner bar at or near the upper chord of a joist, yet which does not require securing the apparatus to the upper joist.

Other objects of this invention will be obvious from the drawings and the detailed description of the invention which follows.

In accordance with this invention there has been provided a combination of a bar joist which includes an upper chord, a lower chord comprising at least one metal angle bar, and an open web secured to the upper and lower chords and triangulating the space therebetween, and adjustable support means secured to the angle bar of the lower chord for supporting a spanner bar. The adjustable support means comprises a base member, means for securing the base member to an angle bar of said lower chord, a first vertically extending elongated member affixed to the base member, a second vertically extending elongated member cooperating with said first member and axially movable therewith, and means for axially moving said second member with respect to said first member and for restricting downward movement of said second member.

This invention provides apparatus for supporting the spanner bars from the lower chord of a joist in which the apparatus is readily movable longitudinally along the lower chord and can readily be adjusted to accommodate joists having a variety of sizes. It is not necessary for the joist to include any special structural features, and an open web joist having at least one angle bar at the lower chord oriented so that one leg of the angle bar is horizontal is all that is required. Furthermore, the apparatus is reusable since by its attachment to the lower chord instead of the upper chord, no part of it becomes incorporated in the concrete slab.

This apparatus is especially useful in combination with open web joists in which the upper chord comprises a pair of spaced-apart angle bars which are adapted to retain concrete between them when pouring the concrete which forms the slab. Ridge-like projections which are thus formed on the lower side of the slab and depend into the channel between the angle bars of the upper chord bear against the upper portion of the bars which form the open web and thus restrict relative horizontal movement between the concrete of the slab and the joists. The present apparatus is particularly useful in conjunction with elements for forming the resulting key-like structure because of its independence from support by the upper chord and the resulting lack of auxiliary structure at the upper chord which tends to interfere with elements which are necessary to form key-lock structures. Co-pending application Ser. No. 829,891, filed Feb. 18, 1986, describes these key-like structures in more detail, and matter in that application which describes such structure is hereby incorporated by reference.

DETAILED DESCRIPTION OF THE INVENTION

Figure 1:
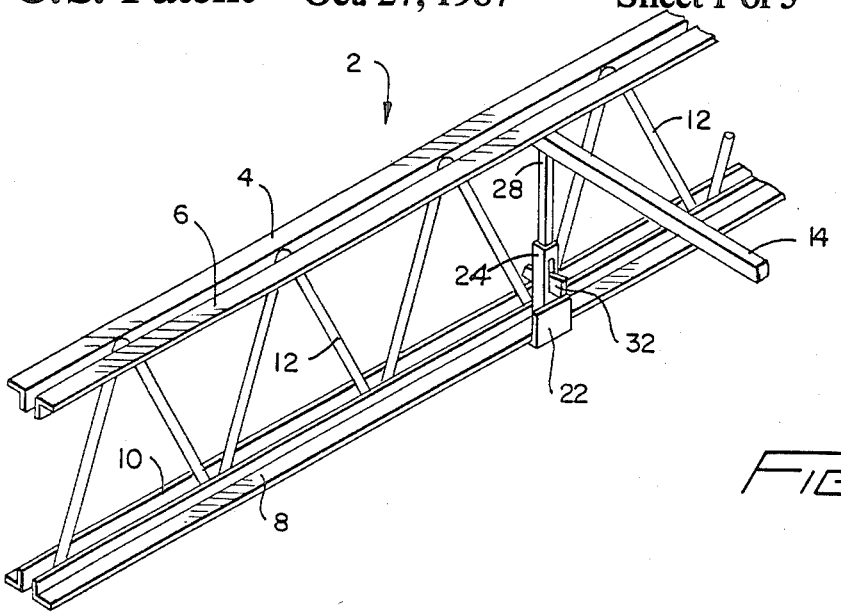
FIG. 1 is a perspective view of an open web joist, an embodiment of the adjustable support means of this invention which is attached to the lower chord thereof, and a spanner bar.
Figure 2:
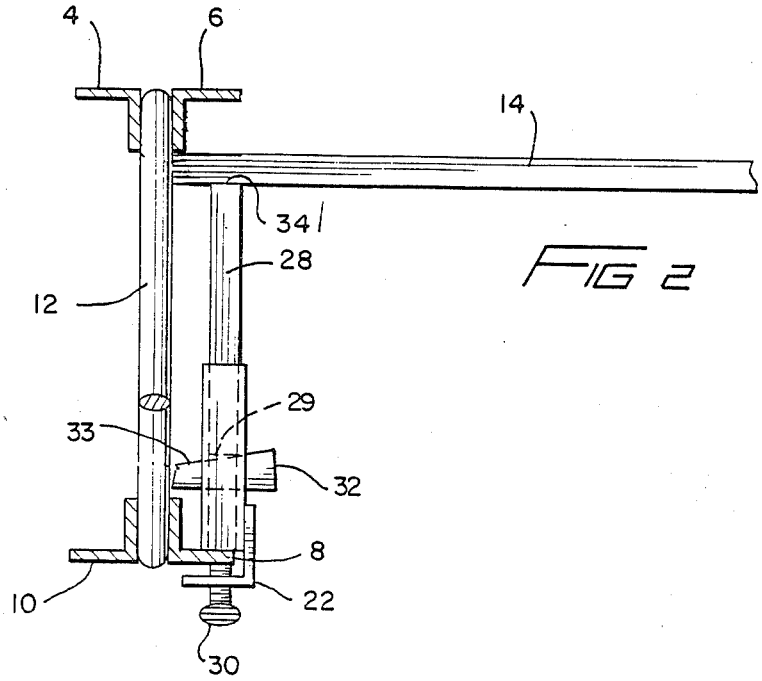
FIG. 2 is a sectional view of the open web joist, adjustable support means and spanner bar of FIG. 1.
Figure 3:
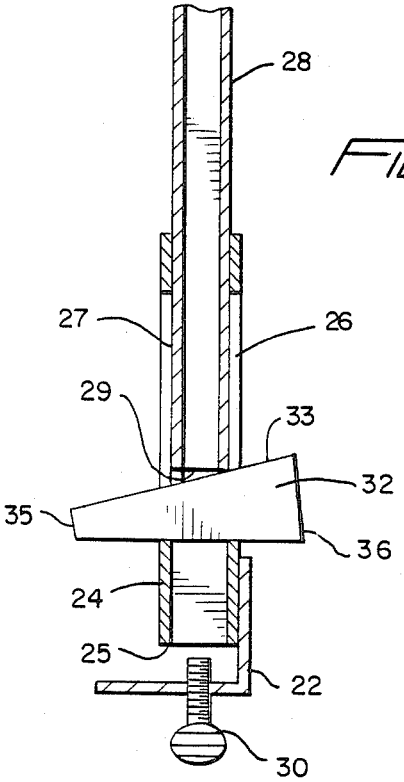
FIG. 3 is a view in section of the adjustable support means shown in FIGS. 1 and 2.
Figure 4:
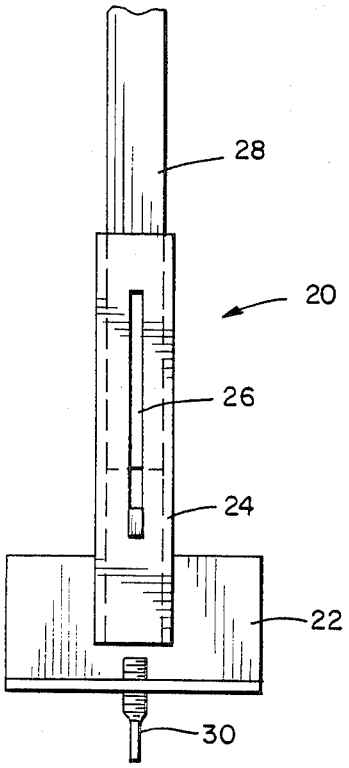
FIG. 4 is a view of the adjustable support means of FIG. 3 from the right hand side thereof.

Referring to the drawings, FIG. 1 shows adjustable support means 20 (see FIG. 4) mounted on an angle bar 8 of the lower chord of open web steel joist 2 and supporting a spanner bar 14. The open web steel joist 2 comprises an upper chord formed from angle bars 4 and 6 and a lower chord formed from angle bars 8 and 10 which are interconnected and spaced apart by web 12. The support 20 comprises a base member shown in the Figures as a short piece of angle bar 22 having channel member 24 affixed to the vertical leg thereof as by welding. The bottom portion of the channel member 24 is spaced upwardly from the horizontal leg of angle bar 22 sufficiently far to permit a horizontal leg of an angle bar of the lower chord to be inserted in the gap between the two. The horizontal leg of the bar 22 is provided with a threaded hole to accommodate thumb screw 30 which is adapted to force the horizontal leg of an angle bar 8 against the lower edge 25 of channel member 24. Upper channel member 28 fits snugly within channel member 24 and is vertically movable towards and away from base member 22. The lower edge 29 of channel member 28 is supported by the upper edge 33 of wedge 32 which passes through slots 26, 27 in channel member 24. The upper surface 33 of wedge 32, in bearing against the lower edge 29 of member 28, forces the upper surface 34 against the lower edge of spanner bar 14, thus securing the spanner bar against the upper chord.

This invention contemplates a spanner bar support structure in which member 28 is secured to the spanner bar 14, as by welding, as well as structure in which member 28 is not affixed to the spanner bar 14.

The adjustable support means 20 is readily adaptable for use with a variety of sizes of joists, either by changing channel member 28 from one length to another, or by using wedges of different sizes.

The size and shape of wedge 32 is selected to permit easy placement of channel 28 under spanner bar 14 when the wedge is in the retracted position and to have the upper edge 34 bear against the spanner bar when the wedge is driven in place. Slots 26 and 27 through which wedge 32 is moved may be relatively short, i.e., they may have a length about that of wide edge 36 of wedge 32, or they may extend a major portion of the length of channel 24. The long slots permit great flexibility in use of the support means 20 since the length of the slot determines the maximum size of the wedge which may be used. The potential for use of wedges having a variety of lengths of sides 36 makes the support 20 readily adaptable for use with joists having different bottom chord to top chord spacings.

The wedge angle must be selected so that frictional forces will retain the wedge in place against downward forces from the spanner bar which tend to move the wedge outwardly. A relatively small angle, such as 10°14 20° is preferred since these small angles resist failure of the support by forcing the wedge out of the slots, and further, provide a high mechanical advantage in forcing the spanner bar upwardly when the supporting apparatus is put in place. Typically, the wedge is driven tightly in place by hammering. An example of a useful wedge is one having the upper edge at an angle of about 15° with the lower edge. For a wedge about 4 inches long, this permits a vertical movement of the axially movable channel from about $\frac{1}{2}$ to about $\frac{3}{4}$ of an inch.

FIGS. 1–4 show a spanner bar support wherein the axially movable channel 28 is insertable within the fixed channel 24. This invention also contemplates apparatus wherein the lower fixed channel has a smaller cross-sectional area than the upper channel and is insertable into the upper axially movable channel. While both channel members are shown in the drawings as having a square cross-section, channels having other shapes with rectangular cross-sections, or even channels having circular cross-sections are contemplated.

The drawings show the use of thumb screw 30 to secure the base member 22 to an angle bar of the lower chord. Other types of screws or threaded bolts may also be used and other clamping means are contemplated and may readily be devised by workers in the art. However, it is preferred that the securing means be operable without the use of hand tools or the need for more than a slight degree of manual dexterity to secure the base member 22 onto the angle bar of the lower chord of the open web joist.

Figure 5:
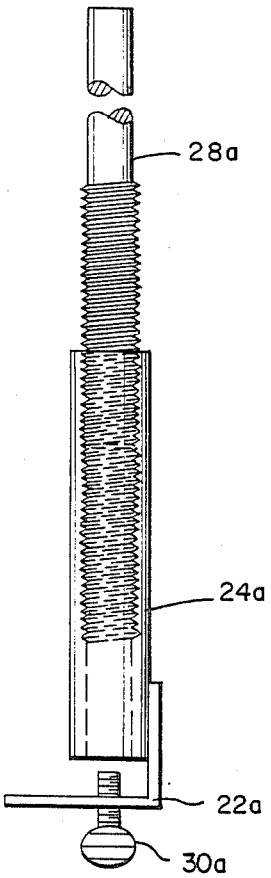
FIG. 5 is a side view of an alternate embodiment of the adjustable support means.

Spanner bar supports other than those which are activated by a wedge are contemplated,, and FIG. 5 shows an alternate embodiment of the spanner bar support in which threaded bar **28*a* is vertically movable within threaded pipe 26*a* by rotating bar 28*a*. Means, not shown, such as a bar extending horizontally through a hole in the upper part of bar 28*a*, may be used to help rotate bar 28*a***.

Figure 6:
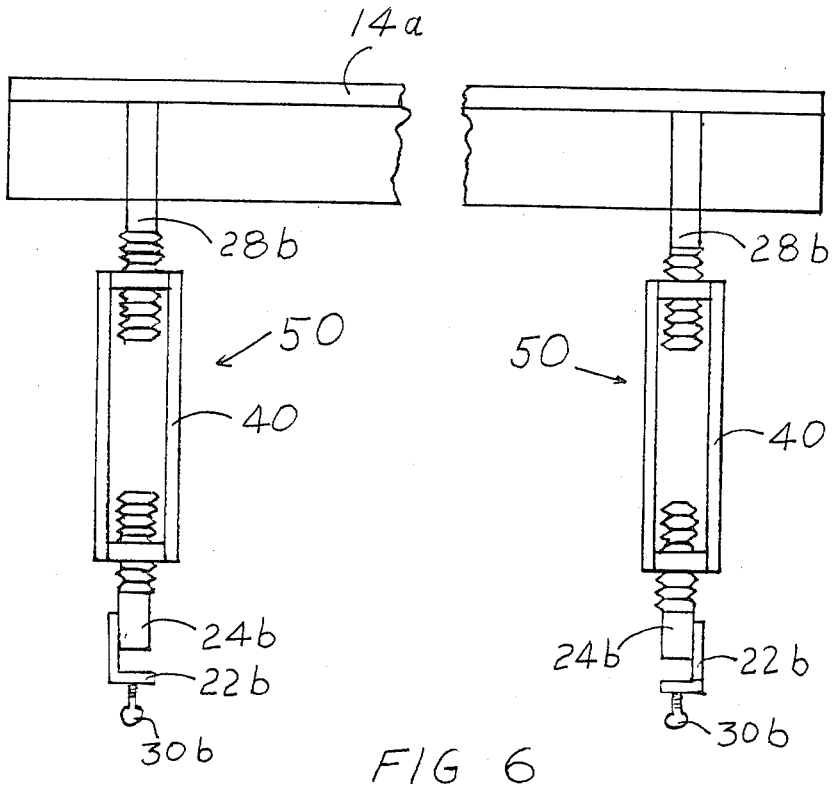
FIG. 6 is a sectional view of another embodiment of the adjustable support means of this invention.

In FIG. 6, which shows another embodiment of this invention, an angle bar **14*a* as a spanner bar is interconnected with base members 22*b* by turnbuckles 50. The spacing between base members 22*b* and spanner bar 14*a* is adjusted by rotating sleeves 40 which changes the spacing between upper bolts 28*b* and lower bolts 24*b*** of the turnbuckle.

As shown in FIG. 6, upper bolts 28 are secured near the ends of the spanner bar **14*a*** as by welding. This invention also contemplates use of turnbuckles in which the upper bolts are not immovably secured to the spanner bar.

The spanner bar **14*a* may exted only between two adjacent joist members, or it may be long enough to extend past three or four or more joists. Preferably the spanner bar 14*a*** is long enough to extend slightly beyond the center lines of the two joists which support the ends of the spanner bar. For example, a spanner bar for extending between two joists which have centerlines 4 feet apart is preferably about 4 feet 2 inches to about 4 feet 4 inches long.

Figure 7:
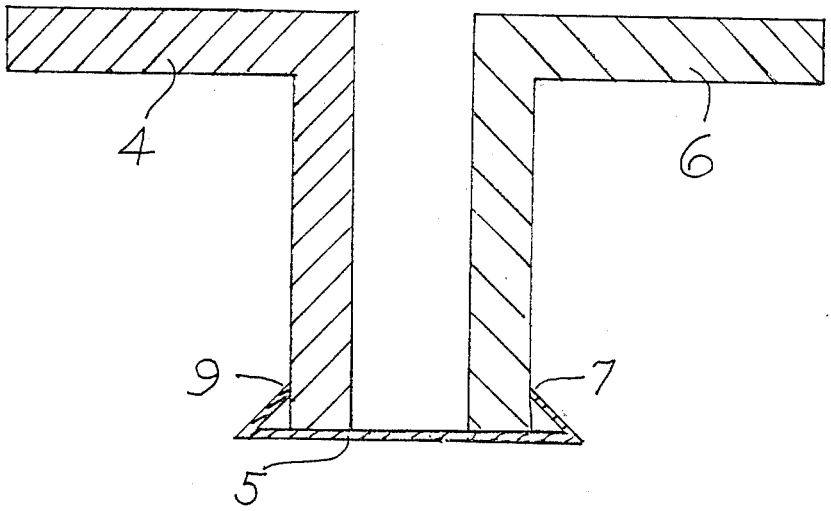
FIG. 7 is a sectional view of a top joist with means for retaining concrete in the channel between two angle bars.

FIG. 7 is a sectional view of the top of a joist showing angle bars 4 and 6 of the upper chord of the joist and closure member 5 which prevents freshly-poured concrete from falling past the upper chord. Closure member 5 is an elongated member which extends between adjacent members of V-shaped portions of the open web.

While closure member 5 may be supported on angle bars 4 and 4 to some extent by spanner bars, it is configured so that the upper edges 7 and 9 press against the outer sides of the vertical legs of angle bars 4 and 6 as shown and retain closure member 5 in place by friction.

Closure member 5 may have other configurations, such as a U-shape, which are adapted to retention on the angle bars by engagement of the inner surface of the side walls of the closure member with the outer surfaces of the angle bars.

The material from which closure member 5 is made is not critical and either plastic or metal, for example, are suitable. In order to provide sufficient rigidity, longitudinal ribs may be provided in closure member 5, and the inner walls of the upper ends which are to bear against the angle bars may be provided with grooves or ridges to reduce the tendency of the closure member 5 to slip off.

As noted above, support 20 is particularly well-adapted for use with the closure member 5, or with the closure member described in Ser. No. 829,891, cited above, since it is entirely supported by the lower chord.

The foregoing is only intended to illustrate the invention and modifications and changes will readily occur to those skilled in the art.

What is claimed is:

1. In combination with a bar joist of the type having an upper chord, a lower chord comprising at least one metal angle bar, said angle bar having a horizontal leg and a vertical leg, and an open web comprising metal bar stock secured to said top and bottom chords and triangulating the space therebetween, and adjustable support means secured to said angle bar of said lower chord for supporting a spanner bar, said adjustable support means comprising:

a base member;

means for securing said base member to said angle bar of said lower chord;

a first vertically extending member affixed to said base member, said first vertically extending member comprising a channel member having a rectangular cross-section and being

2. In combination with a bar joist of the type having an upper chord, a lower chord comprising at least one metal angle bar, said angle bar having a horizontal leg and a vertical leg, and an open web comprising metal bar stock secured to said top and bottom chords and triangulating the space therebetween, and adjustable support means secured to said angle bar of said lower chord for supporting a spanner bar, said adjustable support means comprising:

a base member;

means for securing said base member to said angle bar of said lower chord;

a first vertically extending member affixed to said base member; and a second vertically extending member cooperating with said first member and axially aligned therewith, said first and second vertically extending members each having a circular cross-section and being threaded to engage each other and move axially with respect to each other.

3. In combination with a bar joist of the type having an upper chord, a lower chord comprising at least one metal angle bar, said angle bar having a horizontal leg and a vertical leg, and an open web comprising metal bar stock secured to said top and bottom chords and triangulating the space therebetween, and adjustable support means secured to said angle bar of said lower chord for supporting a spanner bar, said adjustable support means comprising:

a base member;

means for securing said base member to said angle bar of said lower chord;

a first vertically extending member affixed to said base member; and a second vertically extending member cooperating with said first member and axially aligned therewith, said first and second vertically extending members comprising bolts of a turnbuckle; and a turnbuckle sleeve for moving said second member with respect to said fixed member.

4. An open web joist system in accordance with claim 1, 2 or 3 wherein said lower chord comprises a pair of spaced-apart parallel metal angle bars.

5. An open web joist system in accordance with claims 1, 2 or 3 wherein said means for securing said base member to an angle bar of said lower chord comprises manually adjustable screw means mounted within said base member and adapted to press the upper surface of said angle bar against a lower edge of said vertically extending base member.

6. An open web joist system in accordance with claim 1 wherein said spanner bar comprises an angle bar.

7. An open web joist system in accordance with claim 1, 2 or 3 wherein said second vertically extending member is immovably secured to said spanner bar.

8. An open web joist system in accordance with claim 1, 2 or 3 wherein said upper chord comprises a pair of spaced-apart parallel metal angle bars, each angle bar having an outwardly directed horizontal leg and a downwardly depending vertical leg, and means are provided for retaining freshly poured concrete within the space between said metal angle bars and extending below the uppermost portion of said open web.

9. An open web joist system in accordance with claim 2 or 3 wherein said means for retaining concrete in place between the space between said metal angle bars comprises a channel, the inner edges of which are secured to the outer edges of the vertical legs of the angle bars of the upper chord.

* * * * *